US005878707A

United States Patent [19]

Ballard

[11] Patent Number: 5,878,707

[45] Date of Patent: Mar. 9, 1999

[54] ROTARY VALVE INTERNAL COMBUSTION ENGINE

[76] Inventor: Donald Ballard, 4507 Little Crest, Houston, Tex. 77093

[21] Appl. No.: 935,231

[22] Filed: Sep. 22, 1997

[51] Int. Cl.[6] ..... F01L 7/16

[52] U.S. Cl. ..... 123/190.17

[58] Field of Search ..... 123/190.17, 190.4, 123/190.5, 190.6, 190.8, 41.4

[56] References Cited

U.S. PATENT DOCUMENTS

| | | | |
|---|---|---|---|
| 1,191,684 | 7/1916 | Fountain et al. . | |
| 2,908,515 | 10/1959 | Schellens . | |
| 3,188,096 | 6/1965 | Wilkinson . | |
| 3,892,220 | 7/1975 | Franz . | |
| 4,007,725 | 2/1977 | Weaver . | |
| 4,016,840 | 4/1977 | Lockshaw . | |
| 4,036,184 | 7/1977 | Guenther . | |
| 4,119,077 | 10/1978 | Vallejos . | |
| 4,198,946 | 4/1980 | Rassey | 123/41.4 |
| 4,201,174 | 5/1980 | Vallejos . | |
| 4,381,737 | 5/1983 | Turner | 123/41.4 |
| 4,517,938 | 5/1985 | Kruger | 123/190.5 |
| 4,976,232 | 12/1990 | Coates | 123/190.17 |
| 5,154,147 | 10/1992 | Muroki | 123/190.17 |
| 5,329,897 | 7/1994 | Hemphill et al. | 123/190.17 |
| 5,526,780 | 6/1996 | Wallis | 123/190.17 |
| 5,626,107 | 5/1997 | De Blasi | 123/190.17 |
| 5,655,494 | 8/1997 | Donaldson, Jr. | 123/190.17 |

*Primary Examiner*—Eric R. Solis
*Attorney, Agent, or Firm*—Kennedy Covington Lobdell & Hickman

[57] ABSTRACT

An improved internal combustion engine includes a rotary valve member fitted into a cylinder head with cylindrical openings formed therein. The rotary valve is driven to bring working fluid delivery and evacuation ports into and out of registry with ports leading to the combustion chamber. A sealing member is provided intermediate the valve member and a combustion chamber to prevent the fuel/air mixture or exhaust gases from blowing into the area intermediate the valve member and the cylinder head and into regions intermediate individual cylinders.

20 Claims, 6 Drawing Sheets

ROTARY VALVE INTERNAL COMBUSTION ENGINE

BACKGROUND OF THE INVENTION

The present invention relates broadly to internal combustion engines and, more particularly, to an improved internal combustion engine having a rotary valve with improved seals.

Rotary valve engines are known generally as variations, with respect to the transfer of gases, on more conventional internal combustion engines. Rotary valve engines typically use a rotating ported cylinder in place of standard poppet valves in the cylinder head. Basically, the cylinder is caused to rotate due to some mechanical linkage with the crank shaft of the engine. The placement of the ports and channels through the cylindrical valve member are caused to go into and out of registry with openings in the cylinder head to feed the fuel/air mixture into the cylinder or to remove exhaust gases therefrom. As may be expected, timing is an important aspect of rotary valve design.

Rotary valve engines, when properly constructed, provide advantages over conventional engines using poppet valves. Initially, the valve train is much simpler in that there are fewer moving parts. Further, since the rotary valve engine is nonreciprocating, impulse forces on the valves and valve components are not present because there is no change of direction in valve movement. Accordingly, rotary valve engines are typically smoother in operation than poppet valve engines. Additionally, the rotary valve engine offers an open port to the combustion chamber instead of a port partially blocked by poppet valve. In addition, the compression ratio of any given engine can be raised by increasing piston excursion distance because there is no poppet valve projecting into the combustion chamber that the piston must avoid along its reciprocatory path within the cylinder. Rotary valve engines provide enhanced high RPM performance because the rotary valve engine does not rely on valve springs to close a valve which, at high RPM, can lag behind the piston. This is especially true in the case of weak or worn valve springs.

Rotary valve engines, in general are well known in the art and have been for quite some time. Examples of rotary valve engine patents include Fountain & Langford, U.S. Pat. No. 1,191,684, Lockshaw U.S. Pat. No. 4,016,840 and Guenther U.S. Pat. No. 4,036,184. Even with these varied and unique approaches, a problem with rotary valve engines, a problem shared with many rotary components, is that of sealing. Rotary valve engines tend to leak if the tolerances are loose enough to permit free rotation, yet closer tolerances tend to make the engine seize.

An approach to the sealing problem is found in the Vallejos U.S. Pat. No. 4,119,077 which applies a complex mechanism to one of the sealing problems. Sealing problems can occur between cylinders along the rotary valve members. Separate, but no less problematic, sealing problems can occur between the combustion chamber and the valve member itself when the ports in the valve member have rotated out of registry with the port in the cylinder head leading to the combustion chamber. However effective the Vallejos 077 sealing apparatus is, Vallejos 077 provides a complex mechanism to achieve the necessary sealing.

SUMMARY OF THE INVENTION

It is accordingly an object of the present invention to provide a simple and effective sealing arrangement for a rotary valve engine to provide an improved rotary valve engine with effective sealing between the combustion chamber and the rotary valve member.

It is another object of the present invention to provide an improved rotary valve internal combustion engine that has effective sealing along the length of the rotary valve member intermediate the cylinders.

To those ends, an improvement in an internal combustion engine having an engine block defining a plurality of cylindrical chambers therein with a plurality of pistons reciprocally disposed in the chambers, with a combustion chamber defined adjacent the pistons for combustion of a fuel/air mixture therein, the pistons being connected to a crankshaft for power takeoff therefrom, the engine having an assembly for supplying a fuel/air mixture for combustion in the combustion chambers and an exhaust system for removal of exhaust gases resulting from combustion with the improvement including a cylinder head formed with a cylindrical opening extending longitudinally therethrough and having a plurality of first ports formed therein with the first ports being in communication with the fuel/air mixture supply assembly and the exhaust system, and the plurality of second ports with the second ports being in communication with the combustion chambers. A valve member is included and is formed as an elongate cylinder and rotatably disposed within the cylindrical opening, the valve member having a plurality of passageways extending radially therethrough at predetermined locations for selective alignment with the ports in the cylinder head for passage of the fuel/air mixture and exhaust gases therethrough. An arrangement is provided for rotating the valve member responsive to rotation of the crankshaft for selective alignment with the ports and the cylinder head according to a predetermined timed sequence for passage of the fuel/air mixture into the combustion chamber for combustion and exhaust gases from the combustion chamber after combustion. At least one sealing member is included which has a body and a sealing surface formed thereon, the sealing member being slidably disposed intermediate the combustion chamber and the valve member with the sealing member having a passageway formed therein for passage of the fuel/air mixture and exhaust gases therethrough with the passageway being coincident with at least one of the second ports in the cylinder head. The sealing member is movable between a first position wherein the sealing surface is in abutment with the valve member and a second position wherein the sealing member is spaced from the valve member, the sealing member being moved from the second position to the first position responsive to pressure from a moving piston.

Preferably, the cylinder head is formed in two portions including an upper portion and a lower portion with the lower portion being attached to the engine block and the upper portion being attached to the lower portion. Both the upper cylinder head portion and lower cylinder head portion are each formed with a generally u-shaped surface therein for forming the cylindrical opening when the upper portion is attached to the lower portion.

The arrangement for rotating the valve member responsive to rotation of the crankshaft includes a gear attached to one end of the valve member for rotation thereof by the crankshaft at a rate for selective alignment of the ports in the valve member with the cylinder head according to the predetermined time sequence. The valve member is preferably formed as a elongate cylinder having at least one channel formed lengthwise therethrough for cooling the valve member. Similarly, it is preferred that the cylinder head be formed with at least one channel extending lengthwise therethrough for cooling the cylinder head.

The sealing member preferably includes a generally cylindrical body having a generally cylindrical sealing tower projecting upwardly as a portion thereof, with the passageway extending through the sealing member between the sealing tower and the body. The sealing tower preferably includes a sealing surface on a distal end thereof with the sealing surface being formed with a contour conforming with an outer surface of the valve member for abutment there against. The sealing member also preferably includes a generally planer compression surface formed on the body oppositely from the sealing tower for receiving force from the piston compressing gases in the cylindrical chamber to move the sealing member into sealing relation with the valve member. Preferably, the cylinder head is formed with at least one well therein concentrically with one of the second port for sliding disposition therein of the sealing member. The sealing member includes at least one sealing ring extending around an outer surface of the body and projecting radially away therefrom for sliding abutment with walls forming the well. The present invention further preferably includes a sealing assembly extending perimetorially around the valve member at a position adjacent the ports on either side of the second ports to isolate each cylindrical chamber from other like cylindrical chambers.

By the above, the present invention provides a simple yet effective arrangement for sealing the region intermediate the combustion chamber and a rotating valve member on a rotary valve engine. Further, the present invention provides a sealing arrangement along the length of the rotary valve member intermediate adjacent cylinders.

DESCRIPTION OF THE PREFERRED EMBODIMENT

Figure 1:
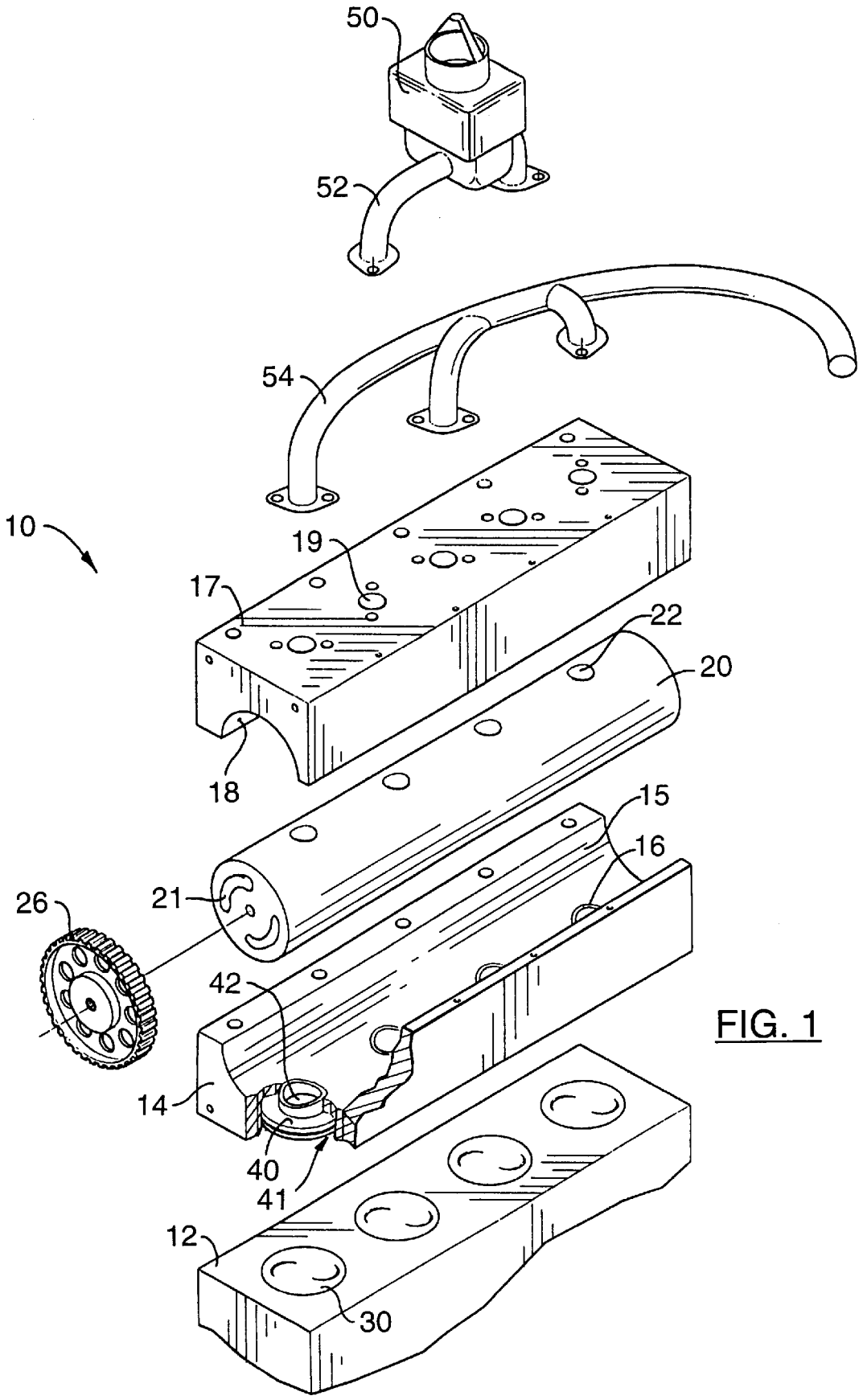
FIG. 1 is an exploded, perspective view of an internal combustion engine including a valve arrangement according to the preferred embodiment of the present invention.
Figure 3:
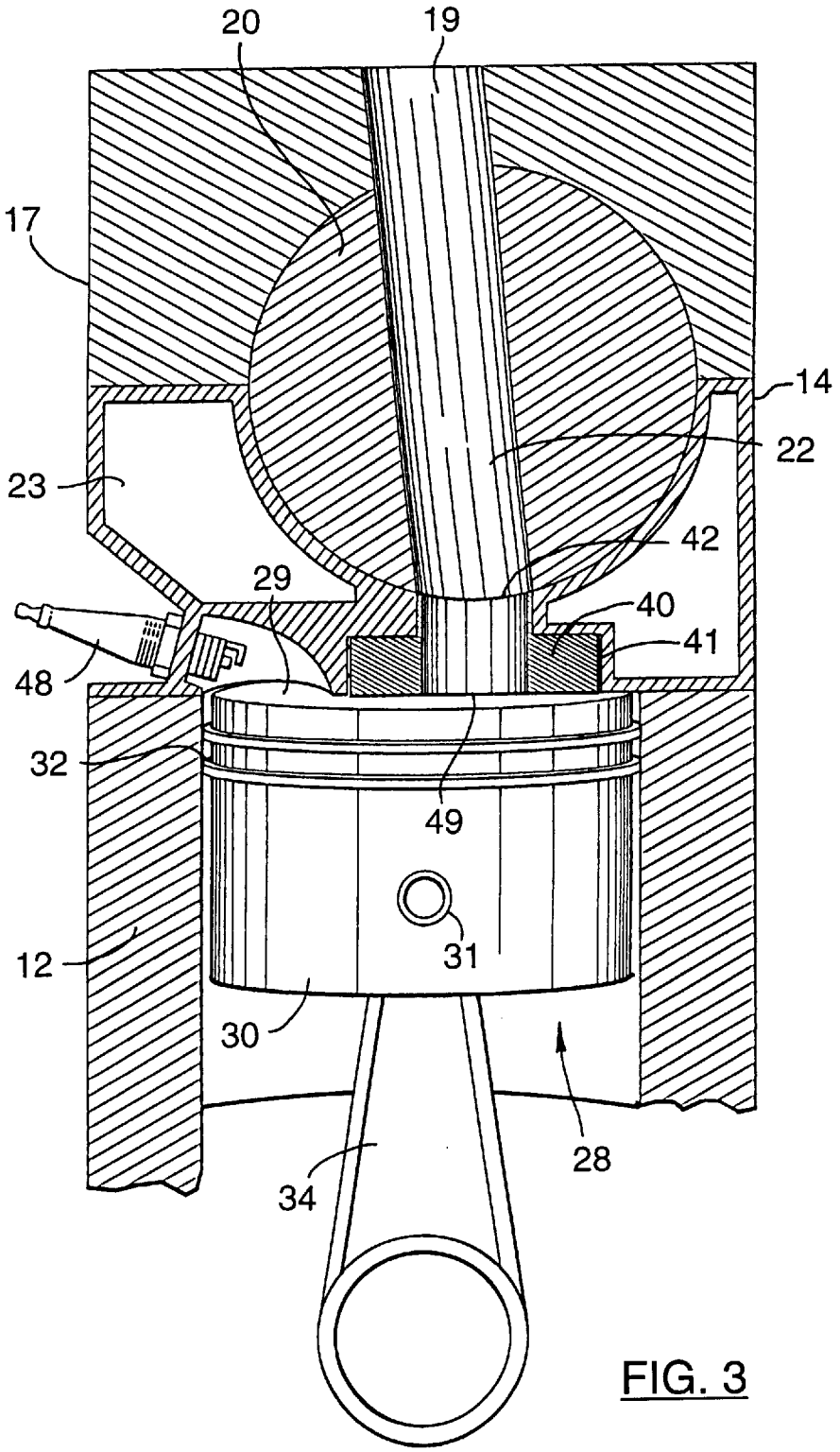
FIG. 3 is a sectional view of an individual cylinder of the internal combustion engine illustrated in FIG. 1 with the piston in a first position.
Figure 4:
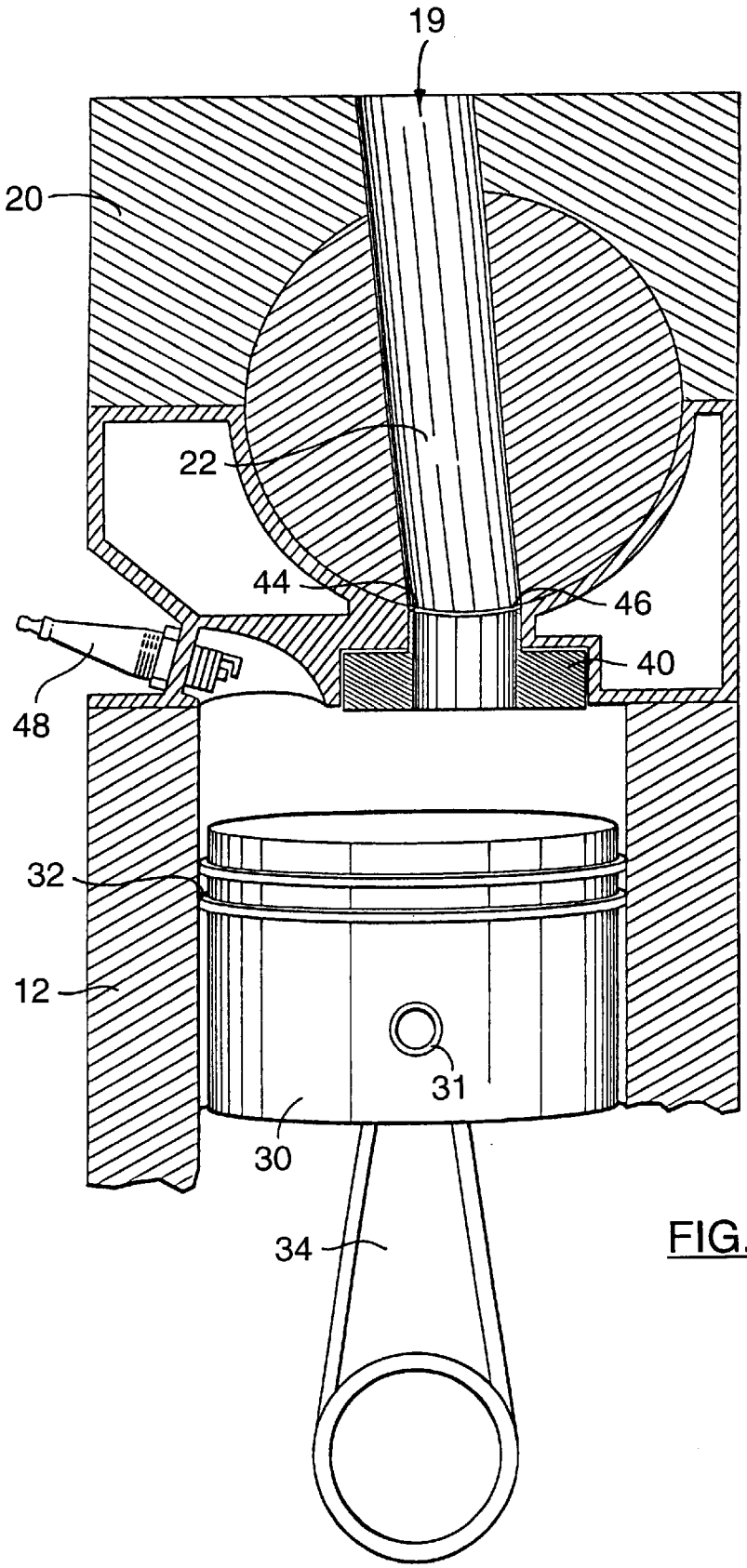
FIG. 4 is a sectional view of the internal combustion engine illustrated in FIG. 3 with the piston at a second position.
Figure 6:
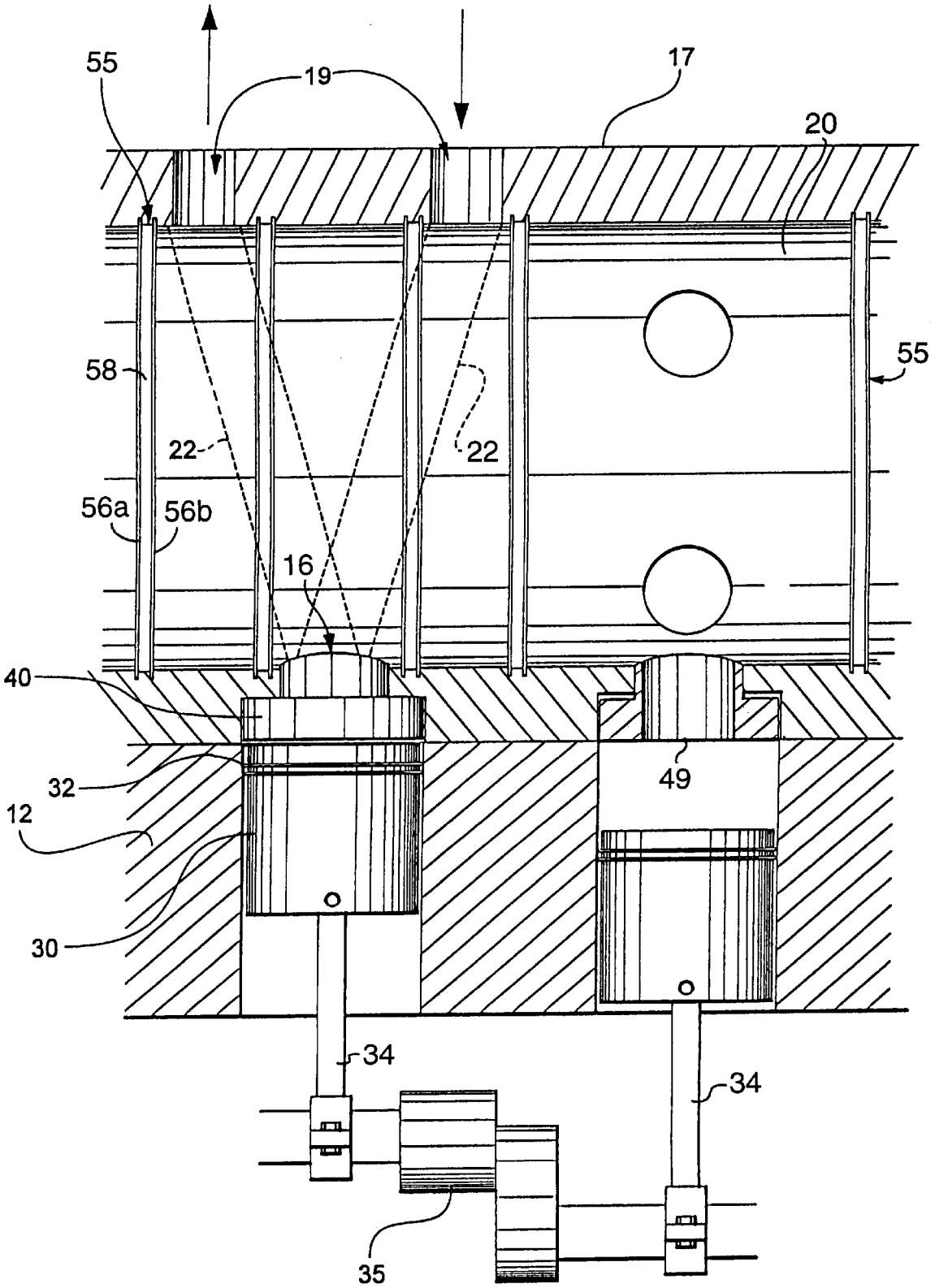
FIG. 6 is a partial cross sectional view of the internal combustion engine illustrated in FIG. 1.

Turning now to the drawings and, more particularly to FIG. 1, an improved internal combustion engine with a rotary valve is illustrated generally at 10 and includes a conventional engine block 12. It should be noted at the outset that the internal combustion engine with respect to the drive train and engine block, as well as the electrical system and fuel delivery system is essentially conventional, this reflecting the adaptability of the present invention to various applications. For clarity, an inline four cylinder engine is illustrated. The engine includes four pistons 30 disposed in cylindrical cavities formed in a row in the engine block. As is conventional and as is seen in FIGS. 3 and 4, a piston 30 from the group is connected to a conventional connecting rod 34 using a pin connector 31. As seen in FIG. 6, the connecting rods 34 are connected to a crankshaft 35 for power takeoff from the moving pistons. As seen in FIGS. 3 and 4, a combustion chamber 29 exists above the piston 30 and a sparkplug 48 is provided for ignition of the fuel/air mixture. Conventional piston rings 32 are attached to the pistons 30 to provide a seal between the combustion chamber 29 and the remainder of the cylinder 28 during reciprocatory movement of the pistons 30.

Returning now to FIG. 1, a lower cylinder head 14 is provided as a cast or molded part and is essentially an elongate rectangle with a generally c-shaped surface 15 formed therein. A series of ports 16 is formed along the deepest portion of the c-shaped surface 15 and extend through the lower cylinder head 14 to provide fluid communication with the combustion chambers. A widening of the ports 16 forming a well 41 occurs in the underside of the lower cylinder head 14. This well 41 is intended to accommodate a sealing member 40. As will be explained in greater detail hereinafter, the sealing member 40 is formed with a passageway 42 extending therethrough and is fitted into the well 41 provided therefore with a portion thereof extending into each of the ports 16.

Figure 2:
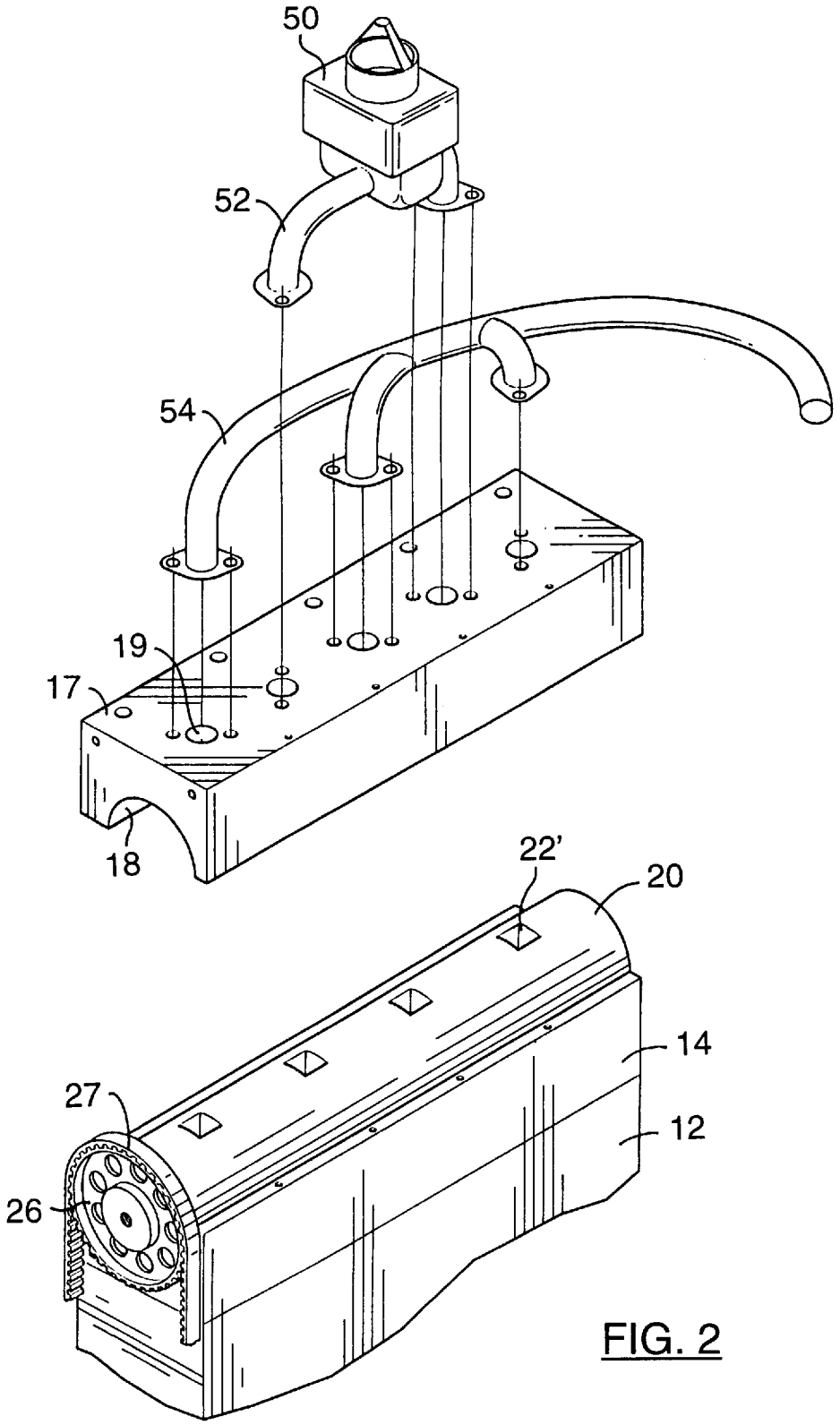
FIG. 2 is a partial exploded view of the internal combustion engine illustrated in FIG. 1.

A valve member 20 is provided to direct the fuel/air mixture from the fuel source through the ports 16 and the lower cylinder head 14 for combustion and to remove post-combustion exhaust gases. The valve member 20 is an elongate cylinder which may be formed from aluminum or other material suitable for machine components. The series of ports 22 are formed in the valve member 20 and extend through the valve member 20 for passing fuel/air mixture and exhaust gases through the valve member 20. The ports are formed at strategic positions where they are configured to arrive in registry with ports in the cylinder head at predetermined time intervals based on the timing sequence of the engine. That is, the ports are configured to provide fuel/air mixture at the combustion chamber when needed and to be present to pass exhaust gases therethrough when needed. To that end, a gear 26 is provided for attachment to the valve member 20 as seen in FIG. 2. A toothed belt 27 is provided for connection of the gear member 26 to the crank shaft for rotation of the valve member 20 responsive to rotation of the crank shaft. Optionally, cooling channels 21, as seen in FIG. 1, may be formed lengthwise in the valve member 20 for air cooling thereof.

As seen in FIG. 2, the ports 22 in the valve member 20 have a square cross section. Optionally, the ports may have an oval cross section. Each type of port will provide different flow characteristics, and experiments have shown the square ports 22' to provide, in any event, the largest port dimension, e.g., the diameter of the circular port or the major diameter of the oval portion, should be approximately ⅛ the diameter of the valve member 20.

An upper cylinder head 17 is formed similarly to the lower cylinder head 14 and includes a complementary c-shaped surface 18 on the underside thereof such that when the upper cylinder head 17 is bolted to the lower cylinder head 14 a cylindrical cavity is formed for containment of the valve member 20. Ports 19 are formed in the upper surface of the upper cylinder head 17 for engagement with an exhaust manifold 54 and an intake manifold 52 having a fuel/air mixture supply illustrated as a carburetor 50 attached thereto. The upper cylinder head 17 is internally chambered to direct fuel air mixture to the correct port and to receive exhaust gases from the correct port in the valve member 20. As seen in FIGS. 3 and 4, the lower cylinder head 14 may be formed with cooling channels 23 extending lengthwise therethrough. Further, the upper cylinder 17 could have similar cooling channels formed therein.

Figure 5:
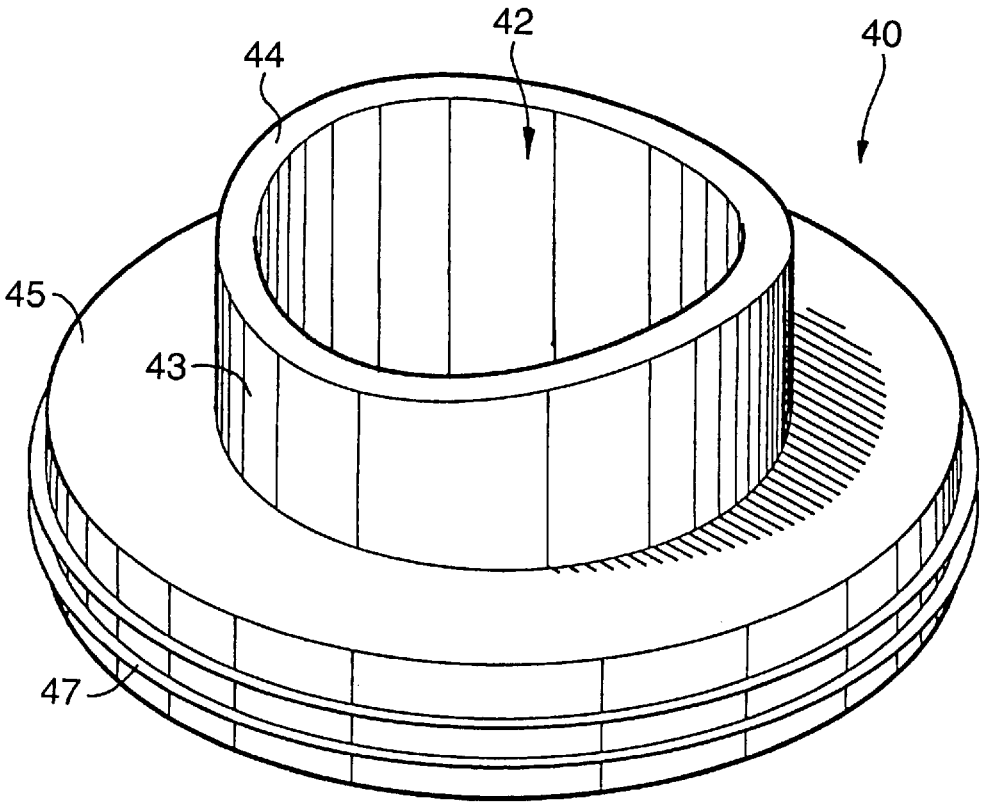
FIG. 5 is a perspective view of a sealing member according to the preferred embodiment of the present invention.

In order to prevent gases from escaping the combustion chamber around the valve member 20, the present invention provides a sealing member 40 illustrated in FIG. 5. The sealing member 40 includes a generally cylindrical body 45 having a generally tubular sealing tower 43 projecting upwardly therefrom. A contoured sealing surface 44 is formed at the distal end of the sealing tower 43. The contour of the sealing surface 44 matches the curvature of the valve member to provide an effective seal at the valve member. A passageway 42 is formed through the sealing member 40 for passage of the fuel/air mixture and exhaust gases therethrough. A pair of sealing rings 47 which function in the same manner as conventional piston rings, are disposed around the outermost perimeter of the body 45 for ultimate disposition intermediate the sealing member 40 and the walls forming the well 41 in which the sealing member resides, as seen in FIG. 6. The sealing member may be retained in the well 41 using a conventional snap ring (not shown) or it may be pinned. The sealing member 40 undergoes minor reciprocatory excursions in coordination with movement of the piston 30 within its well 41 as seen in FIG. 3. The underside of the sealing member 40 includes a pressure surface 49 as seen in FIG. 6 to receive pressure created by the moving piston during an upstroke to drive the sealing member 40 into sealing contact with the valve member 20 as seen in FIG. 3. On the downstroke of the piston, as seen in FIG. 4, the sealing member 40 drops away from its sealing position against the valve member 20.

In operation, the present invention, aside from the valve train, operates in the manner of a conventional internal combustion engine. The fuel/air mixture is periodically injected into the combustion chambers and, according to a predetermined timing sequence, the spark plug 48 fires thereby igniting the fuel/air mixture and driving the piston downwardly under the force expanding gases of the explosion. Due to the eccentric nature of the crankshaft 35 the piston is driven upwardly as other pistons are driven downwardly to evacuate the exhaust gases from the combustion chamber. Rotation of the crankshaft 35 also causes rotation of the valve member 20 in accordance with the aforesaid predetermined timing sequence. The ports 22 in the valve member 20 periodically go in and out of registry with the ports in the upper cylinder head 17 to align these ports with the intake ports 16 in the lower cylinder head 14 to inject the fuel/air mixture through the passageway 42 formed in the sealing member 40 and into the combustion chamber 29. In a similar manner, exhaust ports 22 in the valve member 20 are also aligned with the ports 16 in the lower cylinder head 14 according to the timed sequence in order to evacuate exhaust gases from the combustion chamber which are forced upwardly by movement of the piston, outwardly through the passageway 42 and the sealing member 40 and ultimately, outwardly through the exhaust system 54 after passing through ports 19 in the upper cylinder head 18.

In order to further enhance combustion chamber sealing, a plurality of valve member sealing rings 55 are disposed circumferentially around the valve member 20 as seen in FIG. 6 at positions on either side of the respective port 16 leading to and from the combustion chamber. As further shown in FIG. 6, each valve member sealing ring 55 has a pair of circular side plates 56*a*, 56*b* arranged in spaced parallel relation to one another. An annular intermediate plate 58 extends between and perpendicular to the pair of circular side plates 56*a*, 56*b* to form a cavity around the circumference of valve member sealing ring 55. The valve member sealing rings 55 are optional for operation but are preferred for their ability to provide enhanced performance. The valve member sealing rings 55 are fitted into grooves formed in the lower cylinder head 14, the upper cylinder head 17 and the valve member 20.

As the valve member 20 rotates and the engine goes through its operational cycles, the pistons reciprocate within the cylinders drawing gases into the combustion chamber, with forces resulting from detonation of the fuel/air mixture maintaining the piston excursions with the upper motion of the piston driving exhaust gases outwardly through the valve member. As the piston reciprocates, the sealing member 40 also reciprocates within its well 41. As seen in FIG. 3 with the piston at the top of the cylinder 28, the sealing member 40 is driven upwardly and into contact with the rotating valve member 20 to allow combustion to occur without the exploding gas being forced outwardly around the valve member 20. As the piston travels downwardly, the sealing member 40 drops away from the valve member 20 to break the seal. The benefits of the sealing member 40 are more evident at lower RPMs, especially under idling conditions, wherein the rotary valve member 20 operates smoothly through rotating valve engines without such a seal.

By the above, the present invention provides an improved internal combustion engine having a rotary valve with a simple, effective sealing member preventing the escape of the engine's working fluid into the region intermediate the cylinder head and the valve member. Further, seals are provided intermediate the individual cylinders.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an internal combustion engine having an engine block defining a plurality of cylindrical chambers therein with a plurality of pistons reciprocally disposed in the chambers, with a combustion chamber defined adjacent the pistons for combustion of a fuel/air mixture therein, the pistons being connected to a crankshaft for power take off therefrom, the engine having an assembly for supplying a fuel/air mixture for combustion in the combustion chambers and an exhaust system for removal of exhaust gases resulting from combustion, the improvement comprising:

a cylinder head formed with a cylindrical opening extending longitudinally therethrough and having a plurality of first ports formed therein, said first ports being in communication with the fuel/air mixture supply assembly and the exhaust system, and a plurality of second ports, said second ports being in communication with the combustion chambers;

a valve member formed as an elongate cylinder and rotatably disposed within said cylindrical opening, said valve member having a plurality of passageways extending radially therethrough at predetermined locations for selective alignment with said ports in said cylinder head for passage of the fuel/air mixture and exhaust gases therethrough;

a gear attached to an end of said valve member for rotation thereof by the crankshaft at a rate for selective alignment with said ports in said cylinder head according to a predetermined timed sequence for passage of the fuel/air mixture into the combustion chamber for combustion and exhaust gases from the combustion chamber after combustion; and at least one sealing member having a body and a sealing surface formed thereon, said sealing member being slidably disposed intermediate the combustion chamber and said valve member, said sealing member having a passageway formed therein for passage of the fuel/air mixture and exhaust gases therethrough, said passageway being coincident with at least one of said second ports in said cylinder head, said sealing member being movable between a first position whereat said sealing surface is in sealing abutment with said valve member and a second position whereat said sealing member is spaced from said valve member and is out of sealing abutment with said valve member.

2. An improved internal combustion engine according to claim 1 wherein said cylinder head is formed in two portions including an upper portion and a lower portion, said lower portion being attached to said engine block and said upper portion being attached to said lower portion.

3. An improved internal combustion engine according to claim 2 wherein said upper cylinder head portion and said lower cylinder head portion each include a generally c-shaped surface formed therein for forming said cylindrical opening when said upper portion is attached to said lower portion.

4. An improved internal combustion engine according to claim 1 wherein said means for rotating said valve member responsive to retation of the crankshaft includes a gear attached to one end of said valve member for rotation thereof by the crankshaft at a rate for selective alignment with said ports in said cylinder head according to said predetermined timed sequence.

5. An improved internal combustion engine according to claim 1 wherein said valve member is formed as an elongate cylinder having at least one channel formed lengthwise therethrough for cooling said valve member.

6. An improved internal combustion engine according to claim 1 wherein said cylinder head is formed with at least one channel extending lengthwise therethrough for cooling said cylinder head.

7. An improved internal combustion engine according to claim 1 wherein said sealing member includes a generally cylindrical body having a generally cylindrical sealing tower projecting upwardly therefrom, with said passageway extending through said sealing member between said sealing tower and sealing tower and said body.

8. An improved internal combustion engine according to claim 7 wherein said sealing tower includes said sealing surface on a distal end thereof, with said sealing surface being formed with a contour conforming with an outer surface of said valve member for abutment thereagainst.

9. An internal combustion engine according to claim 7 wherein said member includes a generally planar compression surface formed on said body oppositely from said sealing tower for receiving force from the piston compressing gases in the cylindrical chamber to move said sealing member from said second position out of sealing relation with said valve member into said first position into sealing relation with said valve member, and for receiving force from combustion of the fuel/air mixture to move said sealing member from said second position out of sealing relation with said valve member into said first position sealing relation with said valve member.

10. An improved internal combustion engine according to claim 7 wherein said cylinder head is formed with at least one well therein concentrically with one of said second ports for sliding disposition therein of said sealing member and said sealing member includes at least one sealing ring extending around an outer surface of said body and projecting radially away therefrom for sliding abutment with walls forming said well.

11. An improved internal combustion engine according to claim 1 and further comprising a sealing assembly extending circumferentially around said valve member at a position adjacent said ports on either side of said second ports to isolate each cylindrical chamber from other like cylindrical chambers; said sealing assembly comprising a pair of circular side plates arranged in spaced parallel relation to one another, and an annular intermediate plate extending between said circular side plates and in perpendicular relation thereto to form a cavity therebetween.

12. An improved internal combustion engine according to claim 1 further comprising a sealing assembly extending circumferentially around said valve member at a position adjacent said ports on either side of said second ports to isolate each cylindrical chamber from other like cylindrical chambers, said lower cylinder head, said upper cylinder head, and said valve member including grooves formed therein for retention therein of said sealing assembly.

13. An improved internal combustion engine according to claim 1 wherein said sealing member consists of an integrally formed single-piece body.

14. In an internal combustion engine having an engine block defining a plurality of cylindrical chambers therein with a plurality of pistons reciprocally disposed in the chambers, with a combustion chamber defined adjacent the pistons for combustion of a fuel/air mixture therein, the pistons being connected to a crankshaft for power take off therefrom, the engine having an assembly for supplying a fuel/air mixture for combustion in the combustion chambers and an exhaust system for removal of exhaust gases resulting from combustion, the improvement comprising:

a cylinder head formed with a cylindrical opening extending longitudinally therethrough and having a plurality of first ports formed therein, said first ports being in communication with the fuel/air mixture supply assembly and the exhaust system, and a plurality of second ports, said second ports being in communication with the combustion chambers, said cylinder head being formed in two portions including an upper portion and a lower portion, said lower portion being attached to said engine block and said upper portion being attached to said lower portion, said upper cylinder head portion and said lower cylinder head portion each being formed with a generally c-shaped surface for forming said cylindrical opening when said upper portion is attached to said lower portion;

a valve member formed as an elongate cylinder and rotatably disposed within said cylindrical opening, said valve member having a plurality of passageways extending radially therethrough at predetermined locations for selective alignment with said ports in said cylinder head for passage of the fuel/air mixture and exhaust gases therethrough;

a gear attached to one end of said valve member for rotation thereof by the crankshaft at a rate for selective alignment with said ports in said cylinder head according to a predetermined timed sequence for passage of the fuel/air mixture into the combustion chamber for combustion and exhaust gases from the combustion chamber after combustion; and at least one sealing member having a generally cylindrical body with a generally cylindrical sealing tower projecting upwardly therefrom, said sealing member being slidably disposed intermediate the combustion chamber and said valve member and having a passageway formed therein and extending through said sealing member between said sealing tower and said body for passage of the fuel/air mixture and exhaust gases therethrough, said passageway being coincident with at least one of said second ports in said cylinder head, said sealing tower including a sealing surface on a distal end thereof, with said sealing surface being formed with a contour conforming with an outer surface of said valve member for sealing abutment thereagainst and a generally planar compression surface formed on said body oppositely from said sealing tower, said sealing member being movable between a first position whereat said sealing surface is in sealing abutment with said valve member and a second position whereat said sealing member is spaced from said valve member and out of sealing abutment with said valve member, said sealing member being moved from said second position to said first position responsive to pressure from both a moving piston and from combustion of the fuel/air mixture.

15. An improved internal combustion engine according to claim 14 wherein said calve member is formed as an elongate cylinder having at least one channel formed lengthwise therethrough for cooling said valve member.

16. An improved internal combustion engine according to claim 14 wherein said cylinder head is formed with at least one channel formed lengthwise therethrough for cooling said cylinder head.

17. An improved internal combustion engine according to claim 14 wherein said cylinder head is formed with at least one well therein concentrically with one of said second ports for sliding disposition therein of said sealing member and said sealing member includes at least one sealing ring extending around an outer surface of said body and projecting radially away therefrom for sliding abutment with walls forming said well.

18. An improved internal combustion engine according to claim 14 and further comprising a sealing assembly extending circumferentially around said valve member at a position adjacent said ports on either side of said second ports to isolate each cylindrical chamber from other like cylindrical chambers; said sealing assembly comprising a pair of circular side plates arranged in spaced parallel relation to one another, and an annular intermediate plate extending between said circular side plates and in perpendicular relation thereto to form a cavity therebetween.

19. An improved internal combustion engine according to claim 14 further comprising a sealing assembly extending circumferentially around said valve member at a position adjacent said ports on either side of said second ports to isolate each cylindrical chamber from other like cylindrical chambers, said lower cylinder head, said upper cylinder head, and said valve member including grooves formed therein for retention therein of said sealing assembly.

20. An improved internal combustion engine according to claim 14 wherein said sealing member consists of an integrally formed single-piece body.

* * * * *